US005295280A

United States Patent [19]

Hudson et al.

[11] Patent Number: 5,295,280

[45] Date of Patent: Mar. 22, 1994

[54] WASHING DEVICE FOR SCRUBBING THE BODY

[75] Inventors: William Hudson; Angela K. Samii, both of New York, N.Y.

[73] Assignee: Bilange, Inc., New York, N.Y.

[21] Appl. No.: 907,819

[22] Filed: Jul. 2, 1992

[51] Int. Cl.[5] ..... A47K 7/02

[52] U.S. Cl. ..... 15/222; 601/154

[58] Field of Search ..... 15/208, 209.1, 210.1, 15/223, 225, 226, 222; 128/63; 401/8

[56] References Cited

U.S. PATENT DOCUMENTS

| | | | |
|---|---|---|---|
| 269,247 | 12/1882 | Waters | 15/222 |
| 717,004 | 12/1902 | Hunt | 15/209.1 |
| 1,424,458 | 8/1922 | Fleisher | 15/208 |
| 1,628,023 | 5/1927 | Adkins | 15/222 |
| 2,737,679 | 3/1956 | Choma | 15/222 |
| 2,754,533 | 7/1956 | Swartout | 15/222 |
| 2,851,714 | 9/1958 | Goodloe . | |
| 2,948,003 | 8/1960 | Tamsberg . | |
| 3,146,479 | 9/1964 | Stoker | 15/118 |
| 3,205,519 | 9/1965 | Nowlin et al. | 15/118 |
| 3,268,938 | 8/1966 | Smith | 15/222 |
| 3,336,618 | 8/1967 | Day . | |
| 3,343,196 | 9/1967 | Barnhouse . | |
| 3,674,374 | 7/1972 | Jennings | 401/8 |
| 3,812,849 | 5/1974 | Giunta | 128/63 |
| 3,875,933 | 4/1975 | Schwab | 15/222 |
| 3,924,288 | 12/1975 | Breland | 15/225 |
| 3,959,841 | 6/1976 | Horne | 15/104.94 |
| 3,977,796 | 8/1976 | Gillespie et al. | 401/8 |
| 4,168,863 | 9/1979 | Hatcher | 300/21 |
| 4,343,061 | 8/1982 | Hanazono | 15/210.1 |
| 4,462,135 | 7/1984 | Sanford | 15/105 |
| 4,606,964 | 8/1986 | Wideman . | |

FOREIGN PATENT DOCUMENTS

| | | | |
|---|---|---|---|
| 526167 | 10/1921 | France | 128/63 |
| 1029241 | 1/1989 | Japan | 15/222 |
| 16009 | of 1909 | United Kingdom | 15/208 |
| 400078 | 10/1933 | United Kingdom | 128/63 |
| 2192327 | 1/1988 | United Kingdom | 15/208 |

*Primary Examiner*—Harvey C. Hornsby
*Assistant Examiner*—Mark Spisich
*Attorney, Agent, or Firm*—Lackenbach Siegel Marzullo Aronson & Greenspan

[57] ABSTRACT

A washing device for scrubbing the body includes an elongate washing member formed of a plurality of interlooped quadrate or box-like links. The gripping handles in the form of loops are connected to the end-most links of the chain-like washing member. Each link is formed of a tube gathered along its axis to provide a plurality of circular or cylindrical undulating layers spaced from each other in a radial direction. The length of the tube and the number of layers are selected to provide a desired width of the loop and to substantially fill the loop in the radial direction when in a relaxed condition. Preferably, the links are formed of fine polymeric filaments arranged in an open netting mesh, such as polyethylene netting.

18 Claims, 3 Drawing Sheets

WASHING DEVICE FOR SCRUBBING THE BODY

BACKGROUND OF THE INVENTION

1. Field of the Invention

This invention generally relates to washing or cleaning implements, and more specifically to a washing device for scrubbing the body while showering or bathing.

2. Description of the Prior Art

Numerous implements have been devised and proposed for use during showering or bathing. A number of these have as their objective facilitation of scrubbing of body surfaces which are difficult to access-such as a person's back. One class of devices which has traditionally been used for this purpose are brushes with generally long handles which can be used to reach normally inaccessible body surfaces. A problem with such brushes, however, is that the bristles of many of these brushes tend to be very soft and provide minimal scrubbing activity. Additionally, the brushes frequently define relatively small areas on which the bristles are mounted. This results in only relatively small areas being scrubbed in any one given time. This also makes it possible to skip over certain areas because of the generally random movements that take place with such brushes. Consequently, not only do small brushes take longer to wash an entire area but some areas may not be washed at all. In order ameliorate this problem, brushes with larger surface areas have been devised. However, the larger the surface area covered by the brush, the heavier the brush is, particularly when it is wet and has absorbed large quantities of water. The larger the brush, therefore, the harder it is to manipulate the brush and the one hand that holds the brush can tire very quickly. It is virtually impossible to hold a brush handle with both hands to reduce the stress normally applied to one hand.

A further problem with brushes is that the amount of pressure that is applied to the brush, and, consequently, the extent of scrubbing action, is limited. The reason for this is that the pressure applied by the bristles of the brush is a function of the force applied by the wrist to the end of the handle on which the bristles are mounted. A relatively large force must be applied by the wrist in order to produce any meaningful scrubbing forces. This additionally tires the arm and particularly the wrist.

SUMMARY OF THE INVENTION

It is, therefore, an object of the present invention to provide a washing device for scrubbing the body which does not possess the disadvantages inherent in some prior art washing devices.

It is another object of the present invention to provide a washing device for scrubbing the body which is simple in construction and economical to manufacture.

It is still another object of the present invention to provide a washing device for scrubbing the body which is convenient to use.

It is yet another object of the present invention to provide a washing device for scrubbing the body which can apply significant scrubbing forces to hard to reach surfaces of the body.

It is a further object of the present invention to provide a washing device for scrubbing the body which involves both hands of the person washing and, therefore, can provide enhanced scrubbing action.

It is still a further object of the present invention to provide a washing device for scrubbing the body which exhibits a gentle abrasive surface for gently scrubbing the body.

It is yet a further object of the present invention to provide a washing device for scrubbing the body which readily conforms to the contours of the body surfaces being washed.

It is an additional object of the present invention to provide a washing device for scrubbing the body which can be made in a manner that is both functional and ornamental.

It is still an additional object of the present invention to provide a washing device for scrubbing the body which does not readily deteriorate after continued use and exposure to water and soap.

In order to achieve the above objects, as well as others which will become apparent hereafter, a washing device for scrubbing the body in accordance with the present invention comprises an elongated washing member having two opposing ends. Gripping means are provided at each end for facilitating gripping thereof by a user while washing. Said washing member is flexible and has a mild abrasive surface for gently scrubbing different portions of the body while substantially conforming to the contours of the body portions being washed. Said washing member has a substantial uniform cross-section and has a substantially porous inner structure to allow water and soap to permeate the surface and interior thereof.

In accordance with the presently preferred embodiment, said washing member is in the nature of a chain formed of a plurality of inter-looped links. The links may be quadrate or box links each defining a substantially cubic three-dimensional space. The porous inner structure of each of the links is preferably formed of an elongate tube defining an axis which is gathered along said axis to provide a plurality of circular or cylindrical undulating layers spaced from each other in a radial direction of the tube. The length of said tube and number of layers being selected to provide a desired width of said loop and to substantially fill said loop along the radial direction when in a relaxed condition thereof. While the individual links forming the washing or scrubbing element may be formed of any suitable material, in accordance with the presently preferred embodiment, such links are formed of polymeric filaments arranged in an open netting mesh. Polyethylene netting, for example, has been found to provide, in the arrangement described, the mild abrasive surface for gently scrubbing different portions of the body.

BRIEF DESCRIPTION OF THE DRAWINGS

The above and other objects will become apparent from a reading of the following description of this invention in connection with the accompanying drawings of a presently preferred embodiment of a brush in accordance with the invention.

DESCRIPTION OF THE PREFERRED EMBODIMENT

Figure 1:
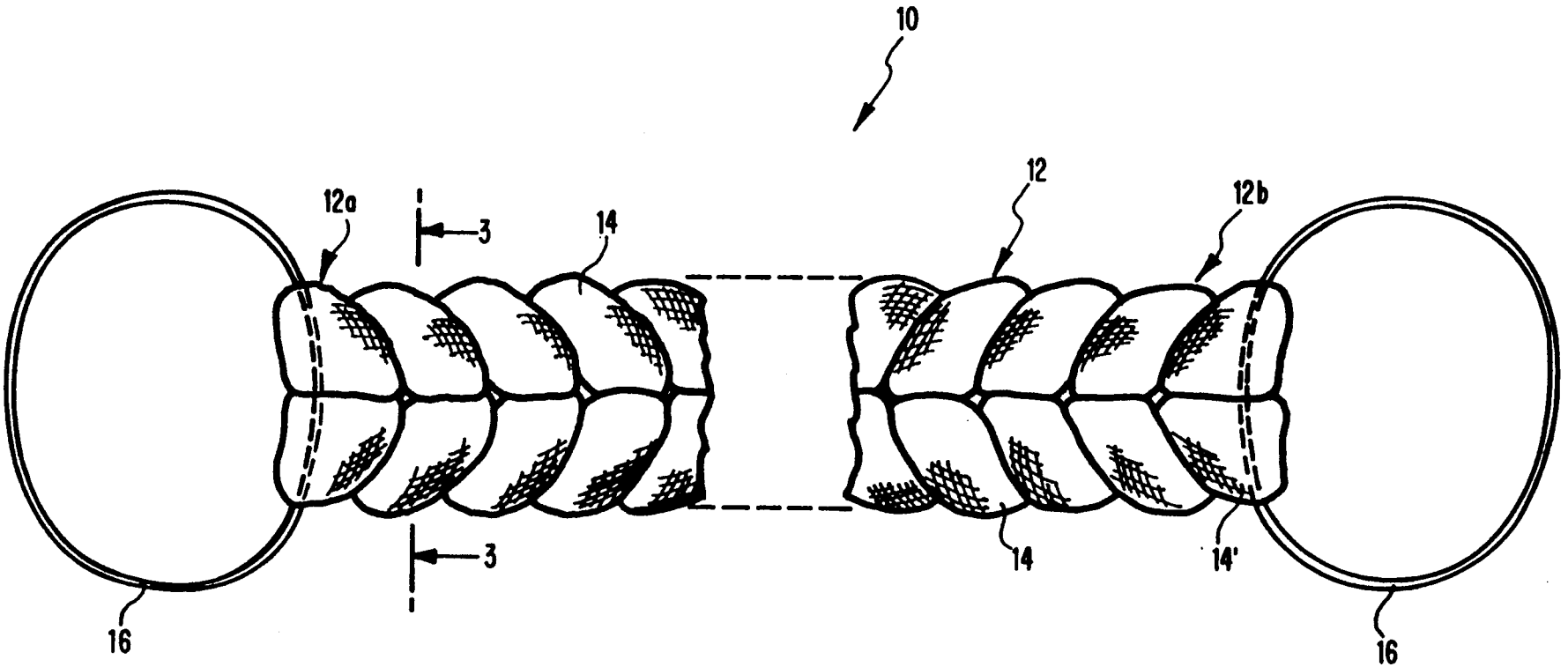
FIG. 1 is diagrammatic plan view of a washing device for scrubbing the body in accordance with the present invention, broken to show omission of at least some of the links similar to the ones shown.

Referring now specifically to the drawings, in which identical or similar parts are designated by the same reference numerals throughout, and first referring to FIG. 1, a washing device for scrubbing the body in accordance with the present invention is generally designated by the reference numeral 10.

The washing device 10 includes an elongated washing member 12 having two opposing ends 12*a* and 12*b*. The elongate washing member 12 has a chain-like construction formed of a plurality of series-connected interior links 14 and end links 14'. The constructions of the links will be described more fully in connection with FIGS. 2–8.

Connected to each of the end links 14' is a gripping element for facilitating gripping thereof by a user while washing. In the embodiment being described, such gripping elements are in the nature of loop straps 16 linked to the end links 14' as will be more fully described hereafter. The straps are preferably made from a non-stretchable material which does not become damaged with prolonged exposure to water. Once such material that can be used is "NYLON".

A desired characteristic of the washing device is that it be flexible and have a mild abrasive surface for gently scrubbing different portions of the body while substantially conforming to the contours of the body portions being washed. Additionally, the device preferably has a substantially uniform cross-section and has a substantially porous inner structure to allow water and soap to permeate the surface and interior thereof. In order to achieve these desirable properties or characteristics of the washing device, the links forming the device are specially constructed as will now be described.

Figure 2:
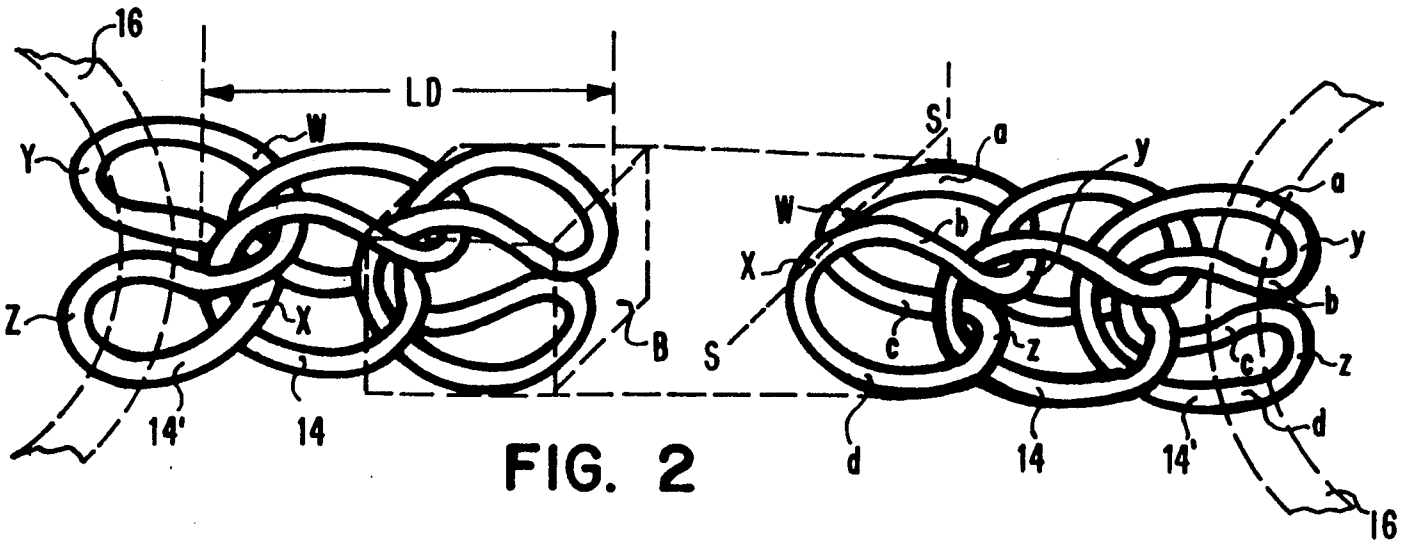
FIG. 2 is a schematic line drawing of the device shown in FIG. 1, to better show the construction and to simplify the description of the various elements making up the washing device and their cooperation with each other.

As indicated, the elongated washing member 12 is formed of a plurality of inter-looped links 14, 14'. Referring to FIG. 2, the links are illustrated diagrammatically to facilitate a description of the configurations of the links and the manner in which they are interconnected or inter-looped with each other and with the strap 16. As shown in FIG. 2, the interior links 14 are each in the nature of quadrate or box links, each defining a substantially cubical three-dimensional space or box-like link B, as shown therein by the dash (phantom) lines. More specifically, each of the links is a continuous loop which can be viewed as having four loop portions. Two opposing spaced loop portions are provided in each one of two mutually orthogonal directions. Thus, in FIG. 2, one typical loop 14 is shown as being formed of segments a, b, c, and d. Segments b and d are joined by curved segment x, the segments a and c are joined by the curved segment w, the segments a and b are connected by curved segment y and segments c and d are connected by curved segment z. Segments a, b and y together define a first loop portion which is spaced from and opposes the loop portion formed by segments c, d, and z. Similarly, the loop portion formed by segments b, d, and x is spaced from and opposes the loop portion formed by segments a, c, and w. Conceptually, the respective opposing loop portions can be viewed as being in substantially parallel planes, although in reality these loops are compressed and distorted in the assembled condition of the washing member 12.

Still referring to FIG. 2, it will be noted that all of the links, with exception of the end link 14' at the left end of the washing member (as viewed in FIG. 2) are similarly oriented so that the curved segments y and z are to the right of each link while the segments w and x are to left of each link. The left most link 14', however, has the curved segments w and x to the right and the curved segments y and z towards the left, as viewed in FIG. 2. Thus, while in most link connections, the curved segments w and x pass through the loops a, b, y, and c, d, z, the last link 14' on the left extends its curved segments w and x through the loop portions a, b, y, and c, d, and z. This positions the link 14', with 90° rotation about the longitudinal direction of the chain, to accept the left most strap 16 through loops a, b, y, and c, d and z. The strap 14, at the right most end, also extends through loop portions a, b, y, and c, d, z, although without the aforementioned rotation orientation.

While the links 14, 14' shown in FIG. 2 schematically or diagrammatically are shown as ropes or strings, they are, in reality, formed of multi-layered fabric which provide a substantial uniform cross-section along the length direction of the chain and has a substantially solid but porous inner structure. This is suggested in FIG. 3, wherein the cross-sections of segments a, b, c, and d of one link 14 are shown as well as the arcuate segments w and x of an adjacent links which engages the link 14.

Figure 5:
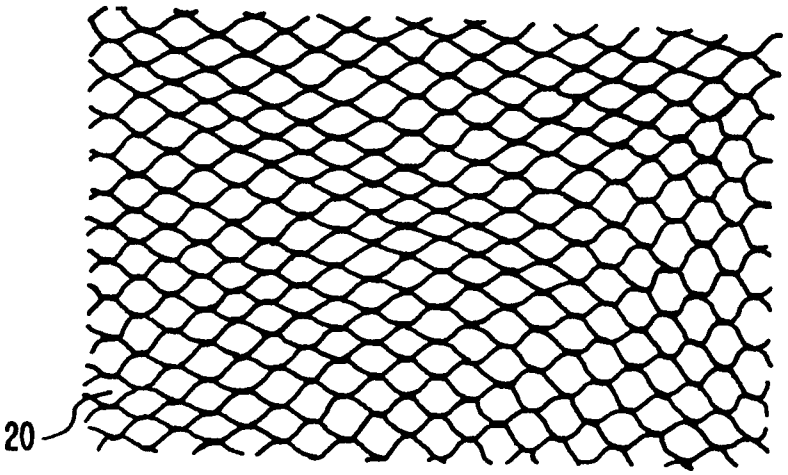
FIG. 5 is a plan view of the open netting mesh material, shown in a slightly stretched state to show the welded filaments which form the open diamond-shaped open mesh pattern.
Figure 4:
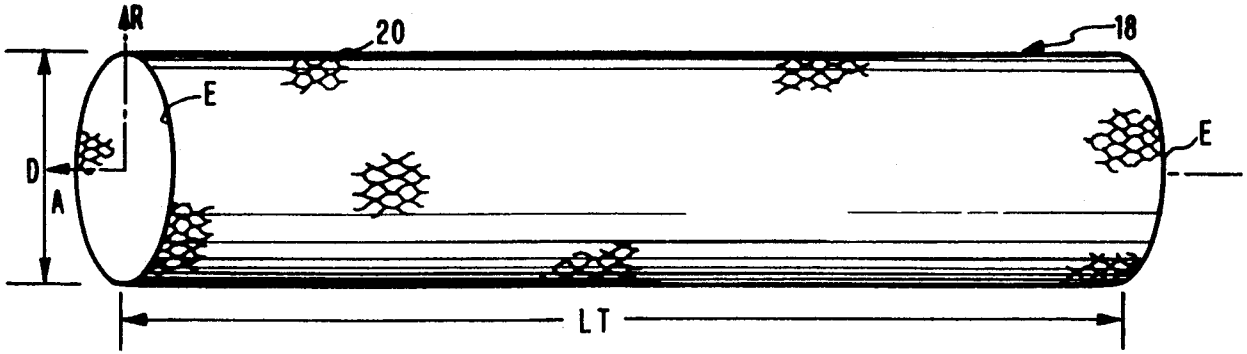
FIG. 4 is a side elevational view of a tube made of mesh netting material used to create the individual links forming the washing device shown in the aforementioned Figures.
Figure 8:
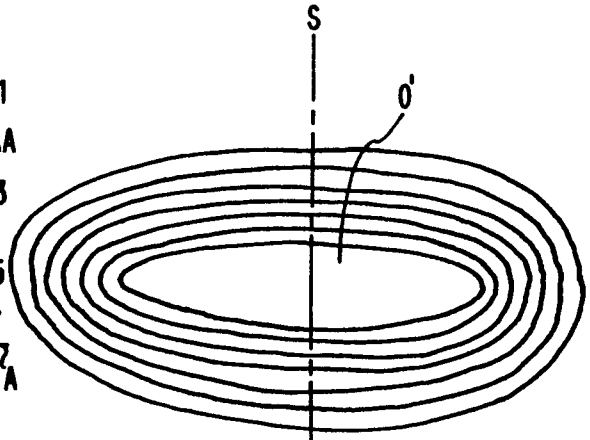
FIG. 8 is similar to FIG. 6, except that the resulting loop is shown in a stretched state to position adjacent circular layers closer to each other and to enlarge the central opening.
Figure 7:
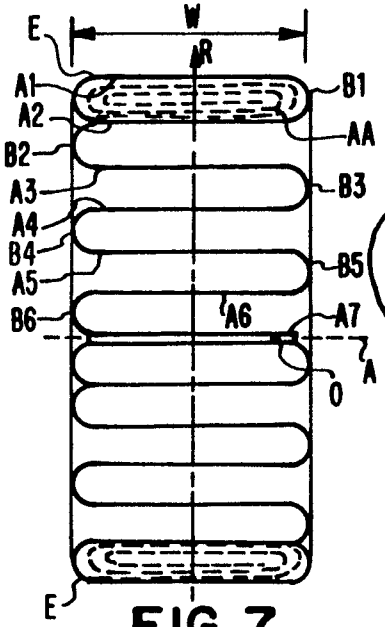
FIG. 7 is a cross-sectional view of the contracted tube shown in FIG. 6, taken along line 7—7.
Figure 6:
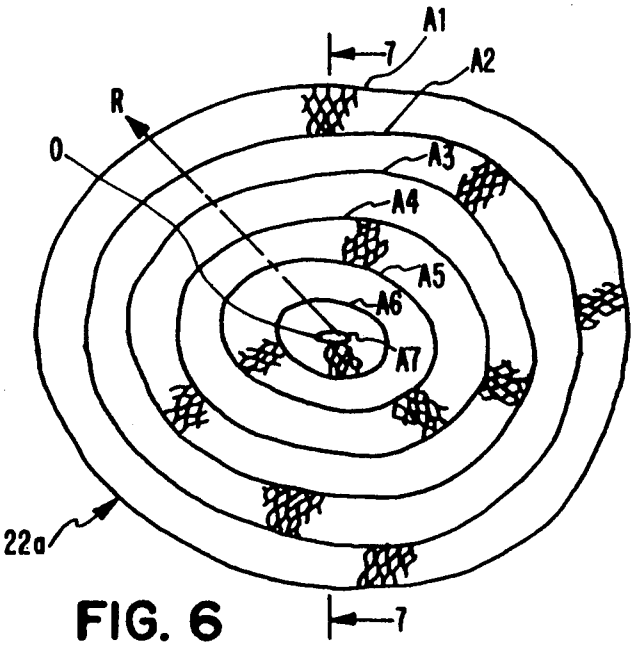
FIG. 6 is a front plan view of the tube shown in FIG. 4 after it has been axially collapsed and gathered to form a plurality of circular or cylindrical undulating layers extending in a radial direction of the tube.

Each link is formed of a closed loop and the construction of such loop as well as its method of assembly will now be described. Referring to FIGS. 4 and 5, a tube of netting mesh 18 is formed of fine polymeric filaments arranged in an open netting mesh. The mesh 20 may be in the form of a polyethylene tube 18 having an axial length LT. In the preferred embodiment, the axial length LT is approximately equal to 40". The diameter of the tube, in its relaxed condition is approximately 2". The closed loop from which the links are made is collapsed and gathered along the axis A of the tube to provide a plurality of circular or cylindrical undulating layers spaced from each other in a radial direction of the tube. Thus, the tube 18 can be gathered or folded upon itself so as to provide a plurality of circular undulating layers extending in a radial direction R of the tube. As best shown in FIGS. 6 and 7, the tube 18 is axially collapsed, forming a plurality of circular or annular undulating layers A1–A7 which extend in and are spaced from each other in the radial direction R of the tube. Each of the layers has width W which is a function of the tube length LT and the number of layers that are formed. With a tube length of 40", approximately 20–27 layers can be created when the width W selected to be 1.5–2". Each of the layers A1–A7 is connected to the next adjoining layer by connecting portions B1–B6. In its relaxed condition, because of the resiliency of the material used, the layers spread over the diameter of the collapsed tube so as to result in a generally small central opening O. Referring to FIG. 8, the loop 22*b* shows the individual layers closer together upon stretching of the loop, thereby increasing the size of the central opening O'. In accordance with the preferred embodiments, the loop 22*a* is formed with 15–30 undulating layers having widths selected within the range of 1–3".

It can been seen, therefore, how the stretched loops 22*b* can be configurated into the links 14, 14', namely by folding the stretched loop about an axis of symmetry 5—5 (shown in FIGS. 2 and 8) in a single plane into a three-dimensional quadrate or box link.

In the presently preferred embodiment, the axial length LL of each link, in its relaxed state, is approximately 2.5" (FIG. 2). However, the axial length of a double link LD is approximately 4", because of some of the axial overlap of each pair of two inter-looped links. Therefore, with 8 links used, the relaxed length LC of the washing member 12 is approximately 16". However, an important feature of the present invention is that the washing member 12*b* stretchable. In fact, the washing member preferably has a stretched-to-relaxed length ratio of at least 2:1. In the embodiment illustrated, the stretched length of each of the links increases from 2.5 to 5" upon stretching. The length LC of the overall washing member 12 increases from 16 to 36" upon stretching. Clearly, while a presently preferred stretched length of approximately 36" facilitates the use of the device for scrubbing and washing one's back, the stretch length can be reduced to, for example, 24". Although increasing the length somewhat of the device facilitates the manipulation thereof behind one's back, excessive length may become a problem in confined spaces such as shower stalls. For this reason, stretched lengths between 24–36" are presently preferred, although this is not critical. In this connection, although 8 links are used in the presently preferred embodiment, clearly the number of links that are used is not critical, and typically 6–10 links can be used, with varying degrees of advantage. With such a construction, each link has a relaxed length along the direction of the washing member within the range of approximately 2–3" and stretched length within the range of 4–6".

Figure 3:
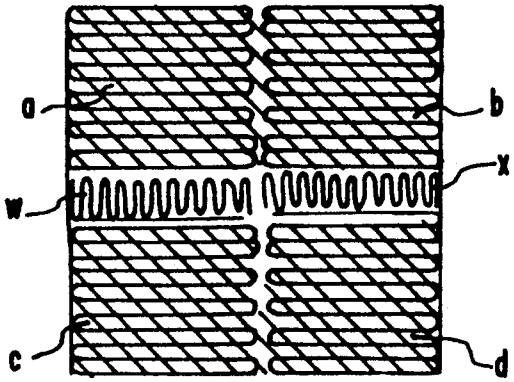
FIG. 3 is a cross-sectional view of the device shown in FIG. 1, taken a long line 3—3.

While the material used to form the links is a generally open netting mesh (FIG. 5), the gathering or multiple folding unto itself of the netting mesh forces the resulting loops 22*a*, 22*b* to substantially occupy the entire volumes defined by the exterior boundaries of the quadrate links, as shown in FIG. 3. By presenting a substantially filled or solid configuration, the links behave like porous sponges which allow them to retain significant quantities of water and soap, making the constructions ideal for bathing. Once the device is no longer being used, it can easily be squeezed out so as to expel the water which has been retained therein.

It will be appreciated that while the link arrangements in FIGS. 1 and 2 are shown to be very regular, and the layers in FIGS. 3, 6 and 7 are likewise shown to be regular and perfectly aligned, this is not a critical feature. Even though the layers may be imperfectly arranged, they still serve as fillers and, therefore, provide the same features or advantages. Thus, for example, referring to FIG. 7, while the layers can be arranged so that the radially outermost layers terminate in the exposed edges E of the tube 18, it should be evident that the outermost layers can be provided with one or more turns AA within the outermost layers, as suggested by the dash outline.

The method of assembling the washing device entails initially folding the tube 18 (FIG. 4) unto itself, or collapsing the tube, in order to result in a plurality of layers which are spaced from each other in the radial direction. The resulting loop 22*a* is thereupon stretched (FIG. 8) and deformed into the shape of the quadrate links 14, 14'. As each link is formed, the curved segments w, z are passed through the loop portions a, b, y, and c, d, z until all of the links have been so interlocked. The remaining link (the left most link in FIG. 2) is similarly inserted but after being rotated 90° so as to pass the link 14' through the loop portions b, d, x, and a, c, w. The straps 16 are thereupon passed through the loop portions a, b, y and c, d, z.

The washing device can be made more ornamental by making the various links of different colors or, for example, alternating link colors so that every other link is of one color and the intermediate links are of another color.

The invention is not limited to the exemplary construction herein shown and described, but may be made in various ways within the scope of the appendant claims.

We claim:

1. Washing device for scrubbing the body comprising an elongate washing member having two opposing ends; and gripping means at each end for facilitating gripping thereof by a user while washing, said washing member being flexible and having a mild abrasive surface for gently scrubbing different portions of the body while substantially conforming to the contours of the body portions being washed and said washing member having a substantially uniform cross-section along the length of said washing member and having a substantially porous interior below said abrasive surface to allow water and soap to permeate said surface and interior thereof, said washing member being formed of a plurality of similar interlooped endless and continuous closed loop links each folded back upon itself,and each folded link defining a substantially cubical three-dimensional space of box-shaped form.

2. A washing device as defined in claim 1, wherein 6–10 links are provided each having a relaxed length within the range of approximately 2–3" and a stretched length within the range of 4–6".

3. A washing device as defined in claim 2, wherein 8 links are used.

4. Washing device for scrubbing the body, comprising: an elongate washing member having two opposing ends; and gripping means at each end for facilitating gripping by a user while washing, said washing member being flexible and having a mild abrasive surface for gently scrubbing different portions of the body while substantially conforming to the contours of the body portions being washed and said washing member having a substantially uniform cross-section along the length of said washing member and a substantially porous interior below said abrasive surface to allow water and soap to permeate said surface and interior thereof, said washing member being formed of a plurality of similar interlooped endless and continuous links each folded back upon itself, and each folded link defining a closed loop, each closed loop being formed of an elongate tube defining a longitudinal axis, each said tube being gathered along said axis to provide a plurality of circular generally undulating layers spaced from each other in a radial direction of said tube from the tube's axis to an outer periphery of said gathered tube, the length of said tube and number of layers being selected to provide a desired width of said loop and substantially fill said loop in said radial direction when in a relaxed condition thereof.

5. A washing device as defined in claim 1 or 4, wherein said washing member is stretchable.

6. A washing device as defined in claim 5, wherein said washing member has a stretched-to-relaxed length ratio of at least 2:1.

7. A washing device as defined in claim 5, wherein said washing member has a stretched length of at least 24".

8. A washing device as defined in claim 7, wherein said washing member has a stretched length of approximately 36".

9. A washing device as defined in claim 4, wherein each said loop is formed with 15–30 undulating layers having widths selected within the range of 1–3".

10. A washing device as defined in claim 9, wherein each said tube is formed of fine polymeric filaments arranged in an open netting mesh.

11. A washing device as defined in claim 10, wherein said filaments are formed of polyethylene netting.

12. A washing device as defined in claim 9, wherein each said tube has a relaxed diameter of approximately 2".

13. A washing device as defined in claim 4, wherein each said tube is formed of fine polymeric filaments arranged in an open netting mesh.

14. A washing device as defined in claim 13, wherein said filaments are formed of polyethylene netting.

15. Washing device for scrubbing the body, comprising: an elongate washing member having two opposing ends; and gripping means at each end for facilitating gripping thereof by user while washing, said washing member being flexible and having a mild abrasive surface for gently scrubbing different portions of the body while substantially conforming to the contours of the body portions being washed and said washing member having a substantially uniform cross-section along the length of said washing member and having a substantially porous interior below said abrasive surface to allow water and soap to permeate the surface and interior thereof, said washing member being formed of a plurality of similar interlooped endless and continuous links each folded back upon itself, and each folded link forming a substantially cubical three-dimensional space of box-shaped form, and wherein each of said links are in the form of a closed loop.

16. Washing device for scrubbing the body, comprising: an elongate washing member having two opposing ends; and gripping means at each end for facilitating gripping thereof by a user while washing, said washing member being flexible and having a mild abrasive surface for gently scrubbing different portions of the body while substantially conforming to the contours of the body portions being washed and said washing member having a substantially uniform cross-section along the length of said washing member and having a substantially porous interior below said abrasive surface to allow water and soap to permeate said surface and interior thereof, said washing surface being formed of a plurality of similar interlooped endless and continuous links each folded back upon itself, and each folded link defining a substantially cubical three-dimensional space of box-shaped form; and said washing member is in the nature of a chain formed of a plurality of interlooped quadrate links, each link being formed of a continuous loop and configurated to provide two opposing spaced loop portions in each one of two mutually orthogonal directions, and the two loop portions of one link arranged along one of said orthogonal directions passing through and engaging the two loop portions of an adjacent link arranged along the other of said orthogonal directions.

17. A washing device as defined in claim 16, wherein said gripping means comprises loop straps extending through a pair of loop portions at the respective ends of said chain.

18. A washing device as defined in claim 17, wherein said loop straps are made of a non-stretchable material.

* * * * *